US009928775B2

(12) United States Patent
Tomitani

(10) Patent No.: US 9,928,775 B2
(45) Date of Patent: Mar. 27, 2018

(54) EL DISPLAY DEVICE AND METHOD OF CONTROLLING THE SAME

(71) Applicant: Japan Display Inc., Tokyo (JP)

(72) Inventor: Hisashi Tomitani, Tokyo (JP)

(73) Assignee: Japan Display Inc., Tokyo (JP)

( * ) Notice: Subject to any disclaimer, the term of this patent is extended or adjusted under 35 U.S.C. 154(b) by 153 days.

(21) Appl. No.: 14/937,118

(22) Filed: Nov. 10, 2015

(65) Prior Publication Data

US 2016/0133183 A1 May 12, 2016

(30) Foreign Application Priority Data

Nov. 10, 2014 (JP) ..... 2014-227925

(51) Int. Cl.
*G09G 3/32* (2016.01)
*G09G 3/3233* (2016.01)

(52) U.S. Cl.
CPC ... *G09G 3/3233* (2013.01); *G09G 2320/0233* (2013.01); *G09G 2330/021* (2013.01)

(58) Field of Classification Search
CPC ..... G09G 3/3233; G09G 2320/0233; G09G 2330/021
See application file for complete search history.

(56) References Cited

U.S. PATENT DOCUMENTS

2013/0154506 A1* 6/2013 Ebisuno ..... H05B 33/08 315/294
2013/0249955 A1* 9/2013 Kim ..... G09G 3/3233 345/690
2014/0152704 A1* 6/2014 Jeong ..... G09G 3/3233 345/690

FOREIGN PATENT DOCUMENTS

JP 2008-151946 A 7/2008
KR 10-2007-0035861 A 4/2007
KR 10-2014-0026231 A 3/2014

OTHER PUBLICATIONS

Korean Office Action dated Jun. 1, 2016 for the corresponding Korean Application No. 10-2015-0149976 with Partial English Translation.

* cited by examiner

*Primary Examiner* — Larry Sternbane
(74) *Attorney, Agent, or Firm* — Typha IP LLC

(57) ABSTRACT

An EL (Electro Luminescence) display device controlling luminosity by a current value supplied to a light emitting element. The EL display device includes a power source supplying a current to the light emitting element and includes a first variable power source and a second variable power source outputting a lower potential than the first variable power source, and a control part changing an output potential of the first variable power source and an output potential of the second variable power source according to acquired maximum luminosity data. Furthermore, the EL display device includes a gate signal output part and a data signal output part, and the control part may change a power source potential of the gate signal output part or a power source potential of the data signal output part according to the maximum luminosity data.

10 Claims, 12 Drawing Sheets

EL DISPLAY DEVICE AND METHOD OF CONTROLLING THE SAME

CROSS REFERENCE TO RELATED APPLICATIONS

This application is based on and claims benefit of priority from the prior Japanese Patent Application No. 2014-227925, filed on Nov. 10, 2014, the entire contents of which are incorporated herein by reference.

FIELD

The present invention is related to an EL display device including a pixel formed from a light emitting element such as an electroluminescence element. In particular, the present invention is related to a power source circuit of an EL display device.

BACKGROUND

An electroluminescence element (referred to below as EL element) is known as a light emitting element utilizing an electroluminescence (EL) phenomenon. An EL element has a structure in which an EL material which serves as a light emitting material is sandwiched between an anode and a cathode and emits light at a wavelength depending on the type of EL material.

When a certain voltage is applied between the anode and cathode of an EL element, current flows between both and an EL material emits light with luminosity according to the value of the current. Therefore, it is possible to make an EL element emit light at a desired luminosity by controlling the current value supplied to the EL element.

FIG. 10 is a diagram for explaining an outline of an EL display device 13. The EL display device 13 is arranged with two power sources for supplying a current to an EL element. Specifically, a first power source 11 which outputs a high potential and a second power source 12 which outputs a lower potential than the first power source 11 are arranged, and the EL display device 13 is controlled by supplying the potential from the two power sources.

FIG. 11 is a diagram showing a circuit structure of an outline of the EL display device 13. A pixel circuit 14 and drive circuit 15 are arranged within the EL display device 13 and both electrically connected via a first power source line 16, a gate signal (scanning signal) 17 and data signal line 18. The first power source line 16 and second power source line 19 are connected to the first power source 11 and second power source 12 respectively. In this way, the first power source 11 and second power source 12 are electrically connected to the pixel circuit 14 respectively.

The pixel circuit 14 is respectively arranged in a plurality of pixels which form a pixel part (display region) of the EL display device 13 and performs control for making the EL element emit light according to image data. Basically, the pixel circuit 14 includes a first transistor 14*a*, second transistor 14*b*, capacitance element 14*c* and EL element 14*d*. The first transistor 14*a* and second transistor 14*b* typically are formed from thin film transistor (TFT).

The drive circuit 15 is a logic circuit which generates a gate signal or data signal supplied to the pixel circuit 14 and is typically arranged as drive IC (Integrated Circuit). Basically, the drive circuit 15 includes a logic buffer 15*a* which supplies a gate signal to the gate signal line 17 and an analog buffer 15*b* which supplies a data signal to the data signal line 18.

In the EL display device 13 shown in FIG. 11, the first power source 11 is connected to the logic buffer 15*a*, analog buffer 15*b*, capacitance element 14*c* and the source of the second transistor 14*b* via the first power source line 16. The second power source 12 is connected to a cathode terminal of the EL element 14*d* via the second power source line 19. In addition, the logic buffer 15*a* is connected to a gate terminal of the first transistor 14*a* via the gate signal line 17, and the analog buffer 15*b* is connected to a source/drain terminal of the first transistor 14*a* via the data signal line 18.

Actually, the pixel circuit 14 is arranged for each of the plurality of pixels arranged in the pixel part of the EL display device 13 and each pixel circuit 14 is connected to a corresponding gate signal line 17 and data signal line 18. The first power source line 16 and second power source line 19 are commonly connected to all of the pixels.

Next, the circuit operation in the EL display device 13 is explained. In the pixel circuit 14, when an active potential (potential for opening the gate of a transistor) is supplied to the gate terminal of the first transistor 14*a* via the gate signal line 17, the first transistor 14*a* is switched to an ON state. In this way, a data signal supplied via the data signal line 18 is stored in the capacitance element 14*c* via the first transistor 14*a*.

The potential stored in the capacitance element 14*c* is also supplied to the gate terminal of the second transistor 16*b*. The second transistor 14*b* flows a current (drain current) according to a potential level of a data signal supplied to a gate terminal and supplies the current to the EL element 14*d*. The EL element 14*d* emits light at a luminosity according to the value of the current supplied from the second transistor 14*b*. That is, when a maximum potential is supplied to the gate terminal of the second transistor 14*b*, the EL element 14*d* emits light at maximum luminosity and when a minimum potential is supplied to the gate terminal, the EL element 14*d* does not emit light.

FIG. 12 is a diagram showing the load characteristics of the second transistor 14*b* and EL element 14*d*. In FIG. 12, the horizontal axis is the difference (power source voltage) between the first power source 11 and second power source 12, and the vertical axis is the current (drain current) flowing between the source and drain of the second transistor 14*b*.

In FIG. 12, the curved line 21 indicates the voltage-current characteristics of the EL element 14*d*, what is called diode characteristics. The EL element 14*d* emits light at a luminosity almost proportional to the value of a current flowing through the element. The curved line 22 indicates the relationship between the voltage between the source and drain of the second transistor 14*b* and a drain current, what is called MOS transistor characteristics. The second transistor 14*b* is arranged with a characteristic which does not flow a drain current in the case where a gate/source voltage (difference between a source potential and gate potential) is below a certain threshold and flows a drain voltage when it is above a certain threshold.

Here, a method of setting a power source voltage in the EL display device 13 is explained using FIG. 12. First, a desired maximum luminosity in the EL display device 13 is determined and based on this the value of a current flowing to the EL element 14*d* is determined. As described above, since the value of a current flowing to the EL element 14*d* and the value of a current flowing to the second transistor 14*b* are the same, the intersection between the curved line 21 and the curved line 22 is an operating point in the case where a maximum luminosity is obtained. On the other hand, in the case of a minimum luminosity, since the EL element 14*d* does not flow a current, the intersection point 27 between the curved line 21 and the horizontal axis becomes the operating point in the case where a minimum luminosity is obtained. In addition, the space between the operating point 23 and the operating point 27 becomes an operating point when displaying at an arbitrary gradation.

In order to consecutively display a luminosity from a minimum luminosity through to a maximum luminosity, the operating point 23 for obtaining a maximum luminosity is required to be set within a saturation region of the second transistor 14*b*, and in order to reduce power consumption to a minimum, usually the operating point 23 when at maximum luminosity is set near a boundary between a saturation region and linear region of the second transistor 14*b*. In this way, it is possible to set the power source voltage to a minimum and minimize power consumption.

Here, in the case where a user lowers the luminosity of an EL display device, the potential of a data signal is lowered and the potential supplied to the gate terminal of the second transistor 14*b* is lowered. That is, the gate voltage of the second transistor 14*b* is lowered. In this case, the relationship between the voltage between the source and drain of the second transistor 14*b* and the drain current changes to the relationship shown in the curved line 24. Therefore, the operating point of a maximum luminosity changes to the intersection point 25 from the intersection point 23.

Here, the curved line 26 plots the boundary between the saturation region and linear region of the second transistor 14*b* with respect to the current characteristics (curved line 22, 24 etc) under various gate voltages. As is clear from FIG. 12, while a user uses an EL display device at a low luminosity, since the operating point 25 is misaligned from the boundary between the saturation region and linear region of the second transistor 14*b* (that is, intersection point between curved line 24 and curved line 26), minimization of power consumption was not achieved.

In addition, in the EL display device 13, since output potential of the first power source 11 and the output potential of the second power source 12 are constant values respectively, in the case where a user lowers luminosity, only a reduction in power equal to the reduction in the value of the current flowing through the EL element 14*d* is obtained and it could not be said that a sufficient reduction in power consumption was achieved.

In order to deal with such problems, a technology is disclosed in the patent document 1 in which an output potential of a power source connected to the cathode of an EL element is lowered in the case where the gate voltage of a transistor connected in series is lowered with respect to the EL element, and the voltage (CV margin) applied to the EL element is decreased. In this way, in the EL display device described in patent document 1, in addition to the reduction in power due to a decrease in the value of a current flowing through the EL element, a reduction in power consumption is achieved by a reduction in power due to a decrease in a CV margin.

SUMMARY

An EL display device in one embodiment of the present invention is an EL display device controlling luminosity by a current value supplied to a light emitting element, the EL display device includes a power source supplying a ] current to the light emitting element and including a first variable power source and a second variable power source outputting a lower potential than the first variable power source, and a control part changing an output potential of the first variable power source and an output potential of the second variable power source according to acquired maximum luminosity data.

The EL display device in another embodiment of the present invention further includes a gate signal output part, and a data signal output part, the control part changing a power source potential of the gate signal output part or a power source potential of the data signal output part according to the maximum luminosity data.

The control part may acquire the maximum luminosity data based on an acquired image signal and may acquire the maximum luminosity data based on acquired user luminosity operation data.

An EL display device in one embodiment of the present invention is a method of controlling an EL display device controlling luminosity by a current value supplied to a light emitting element and including a power source supplying a current to the light emitting element including a first variable power source and a second variable power source outputting a lower potential than the first variable power source, and a control part making an output potential of the power source variable, the method includes the control part changing an output potential of the first variable power source and an output potential of the second variable power source according to acquired maximum luminosity data.

The EL display device in another embodiment of the present invention further includes a gate signal output part, and a data signal output part, the control part changing a power source potential of the gate signal output part or a power source potential of the data signal output part according to the maximum luminosity data.

The control part may acquire the maximum luminosity data based on an acquired image signal and may acquire the maximum luminosity data based on acquired user luminosity operation data.

DESCRIPTION OF EMBODIMENTS

The technology described in the patent document 1 focuses only on reducing power consumed by an EL element and did not consider power consumed by other drive circuits. That is, the patent document 1 lacks the point of view of reducing power across the entire EL display device and there was no room for further improvement in low power consumption of an EL display device.

Therefore, one aim of the present invention is to provide a technology to reduce power consumption of an EL display device. In particular, it is an aim of the present invention to provide an EL display device which reduces power consumption not just of an EL display element but also of other drive circuits.

Each embodiment of the present invention is explained below while referring to the diagrams. However, the present invention can be realized by various forms that does not depart from the scope of the present invention and should not be interpreted as being limited to the content described in the embodiments exemplified herein. In addition, in each diagram of the present specification, the same reference symbols are attached to elements that have been explained in relation to previous diagrams and elements with the same function and therefore overlapping explanations are sometimes omitted.

Figure 1:
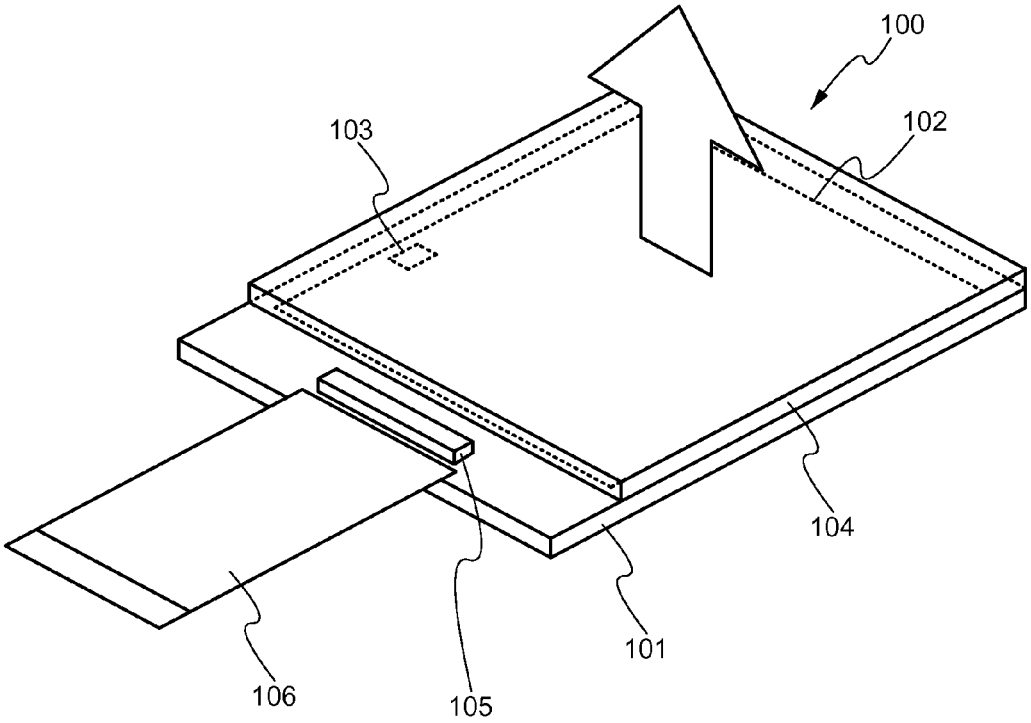
FIG. 1 is a diagram showing an external structure in an EL display device related to an embodiment of the present invention.

FIG. 1 is a diagram showing an entire structure of an organic EL display device 100 in an embodiment of the present invention. The organic EL display device 100 of the present embodiment includes a pixel part 102 above a first substrate 101 for forming elements. The pixel part 102 is arranged with a pixel 103 in a matrix shape and a pixel circuit described below is incorporated into each pixel 103. A second substrate 104 is arranged as a sealing material above the first substrate 101 and has a structure for preventing the infiltration of water from the exterior. Light output from the pixel part 102 is emitted in the direction of the arrow and is observed by a user.

A drive IC (Integrated Circuit) 105 is arranged by a mounting method such as flip chip and the like as an external IC above the first substrate 101. The drive IC 105 is a logic circuit which outputs a signal for driving an active element such as a thin film transistor arranged in the pixel part 102 and mainly functions as a gate line drive circuit and data line drive circuit. Input and output of a signal to and from the drive IC 105 is performed via a FPC (Flexible Print Circuit) 106.

Furthermore, although an example is shown in the present embodiment in which the drive IC 105 is provide with a gate line drive circuit and data line drive circuit function, it is also possible to form a gate line drive circuit and data line drive circuit using a thin film transistor above the first substrate 101. It is possible to form a gate line drive circuit above the first substrate 101 and the function of a data line drive circuit can be incorporated into the drive IC 105.

In the EL display device 100 of the present embodiment, although a power source drive circuit described herein may be incorporated into the drive IC 105, a separate IC (a power management IC for example) from the drive IC 105 may also be arranged.

A data signal is applied according to image data from the drive IC 105 and a gate signal matching a certain timing is applied to each pixel which forms the pixel part 102 shown in FIG. 1. By applying the data signal and gate signal to a transistor arranged in each pixel, it is possible to perform a screen display according to the image data. Typically it is possible to use a thin film transistor using thin film formation technology as the transistor. However, the transistor is not limited to a thin film transistor and any element may be used as long as the element can control a current amount.

Figure 2:
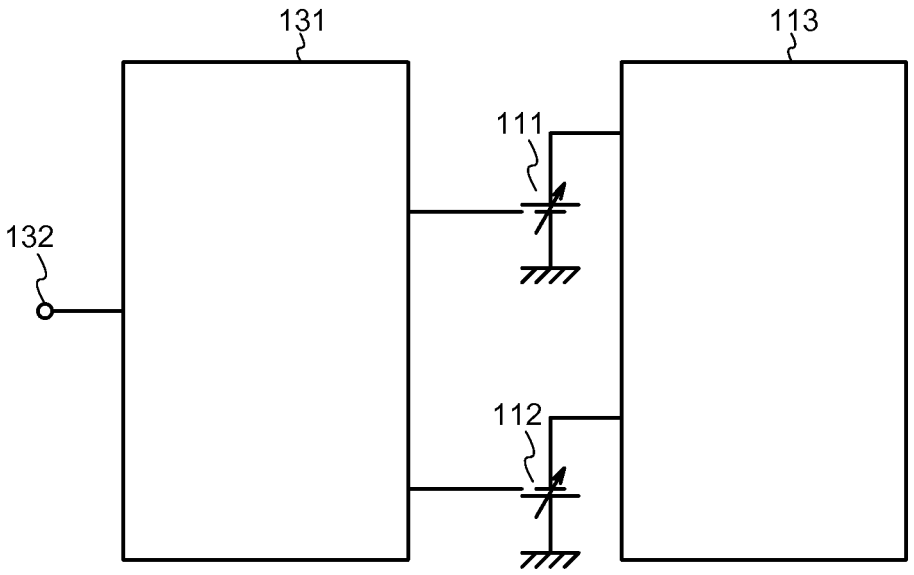
FIG. 2 is a diagram showing a circuit structure in an EL display device related to an embodiment of the present invention.

FIG. 2 is a diagram showing an approximate pixel structure in the EL display device 100 in the present embodiment. The EL display device 100 in the present embodiment is arranged with two variable power sources for use as power sources of an EL element and drive IC. Specifically, a first variable power source 111 which outputs a high potential and a second variable power source 112 which outputs a lower potential than the first variable power source are arranged, and a display control circuit 113 is controlled by the output potential of these two power sources. Here, the display control circuit 113 is a generic name for a circuit group including a pixel circuit included in the pixel part 112 described above and a drive circuit included in the drive IC 105.

In addition, the EL display device 100 in the present embodiment includes a power source control circuit 131 for controlling the first variable power source 111 and second variable power source 112. The power source control circuit 131 is a control circuit for adjusting the output potential of the first variable power source 111 and second variable power source 112 according to a luminosity setting signal input from an external input terminal 132. In the present embodiment, a signal based on maximum luminosity data is used as the luminosity setting signal. Maximum luminosity data is data which expresses maximum luminosity which the EL display device attempts to output, and may be acquired based on an image signal or based on luminosity operation data of a user.

Furthermore, although the display control circuit 113 and power source control circuit 131 are described as separated circuits, it is possible to incorporate the function of the power source control circuit 131 into the display control circuit 113. In this case, the power source control circuit 131 may be incorporated into the drive IC 105 shown in FIG. 1 for example.

Figure 3:
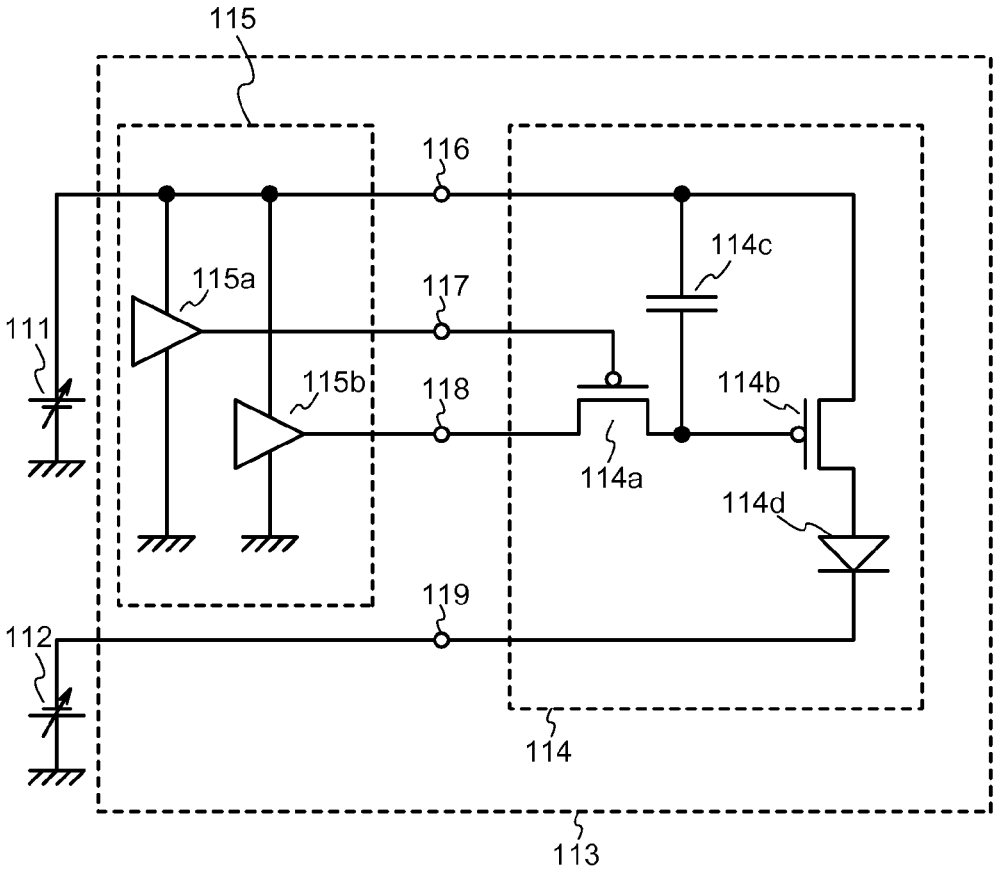
FIG. 3 is a diagram showing a circuit structure of a display control circuit in an EL display device related to an embodiment of the present invention.

FIG. 3 is a diagram showing a circuit structure within the display control circuit 113. A pixel circuit 114 and drive circuit 115 are arranged within the display control circuit 113 shown in FIG. 3 and both are electrically connected via a first power source line 114, gate signal (scanning signal) line 117 and data signal (image signal) line 118. The first power source line 116 and second power source line 119 are connected to the first variable power source 111 and second variable power source 112 respectively. In this way, the first variable power source 111 and second variable power source 112 are electrically connected to the pixel circuit 114 respectively.

The pixel circuit 114 is a circuit in which each of a plurality of pixels 103 which form the pixel part 102 of the EL display device 100 shown in FIG. 1 is arranged and performs control for causing an EL element to emit light according to image data. Basically, the pixel circuit 114 has a structure including a first transistor 114*a*, second transistor 114*b*, capacitance element 114*c* and EL element 114*d*. The first transistor 114*a* functions as a switch when a data signal is input to each pixel. The second transistor 114*b* is used for adjusting the value of a current supplied to the EL element 114*d*. The capacitance element 114*c* includes a function for storing a potential supplied to a gate terminal of the second transistor 114*b* when each pixel is in an OFF state.

The first transistor 114*a* and the second transistor 114*b* typically can be formed using a thin film transistor. In the present embodiment, although the first transistor 114*a* and second transistor 114*b* are formed using a P channel type transistor, the first and second transistors may also be formed using a N channel type transistor. However, in this case, since the direction of a flowing current is reversed, the relationship of the output potential of the first variable power source 111 and second variable power source 112 and the direction of the EL element 114 are reversed.

The drive circuit 115 is a logic circuit which generates a gate signal and data signal supplied to the pixel circuit 114. Basically, the drive circuit 115 has a structure including a logic buffer (gate signal output part) 115*a* which supplies a gate signal to the gate signal line 117, and an analog buffer (data signal output part) 115*b* which supplies a data signal to the data signal line 118. Furthermore, although a pixel structure is simplified in FIG. 3, actually, since a pixel circuit 114 is arranged in each pixel, a plurality of first power source lines 116, a plurality of gate signal lines 117 and plurality of data signal lines 118 are arranged in a matrix shape in the pixel part 102.

In the display control circuit 113 having the structure described above, the first variable power source 111 is connected to the logic buffer 115*a*, analog buffer 115*b*, capacitance element 114*c* and source terminal of the second transistor 114*b* via the first power source line 116. The second variable power source 112 is connected to the cathode terminal of the EL element 114*d* via the second power source line 119. In addition, the logic buffer 115*a* is connected to the gate terminal of the first transistor 114*a* via the gate signal line 117 and the analog buffer 115*b* is connected to the source/drain terminal of the first transistor 114*a* via the data signal line 118. In addition, the first power source line 116 and second power source line 119 are commonly connected to all of the pixels.

Next, a circuit operation in the EL display device 100 of the present embodiment is explained. In the pixel circuit 114, when a gate signal of an active potential output from the logic buffer 115*a* is supplied to the gate terminal of the first transistor 114*a* via the gate signal line 117, the first transistor 114*a* is switched to an ON state. In this way, a data signal output from the analog buffer 115*b* is stored in the capacitance element 114*c* via the data signal line 118 and first transistor 114*a*.

The data signal stored in the capacitance 114*c* is also supplied to the gate terminal of the second transistor 114*b*. The second transistor 114*b* flows a current (drain current) according to the potential level of the data signal supplied to the gate terminal and the voltage difference between the first variable power source 111 and second variable power source 112 (voltage supplied between the source and drain of the second transistor 114*b*) and supplied the current to the EL element 114*d*. The EL element 114*d* emits light at a luminosity according to the value of the current supplied from the second transistor 114*b*.

That is, when a maximum potential is supplied to the gate terminal of the second transistor 114*b*, a maximum current flows to the EL element 114*d* and the EL element 114*d* emits light at maximum luminosity. Reversely, since a current does not flow to the EL element 114*d* when a minimum potential is supplied to the gate terminal, the EL element 114*d* does not emit light.

Figure 4:
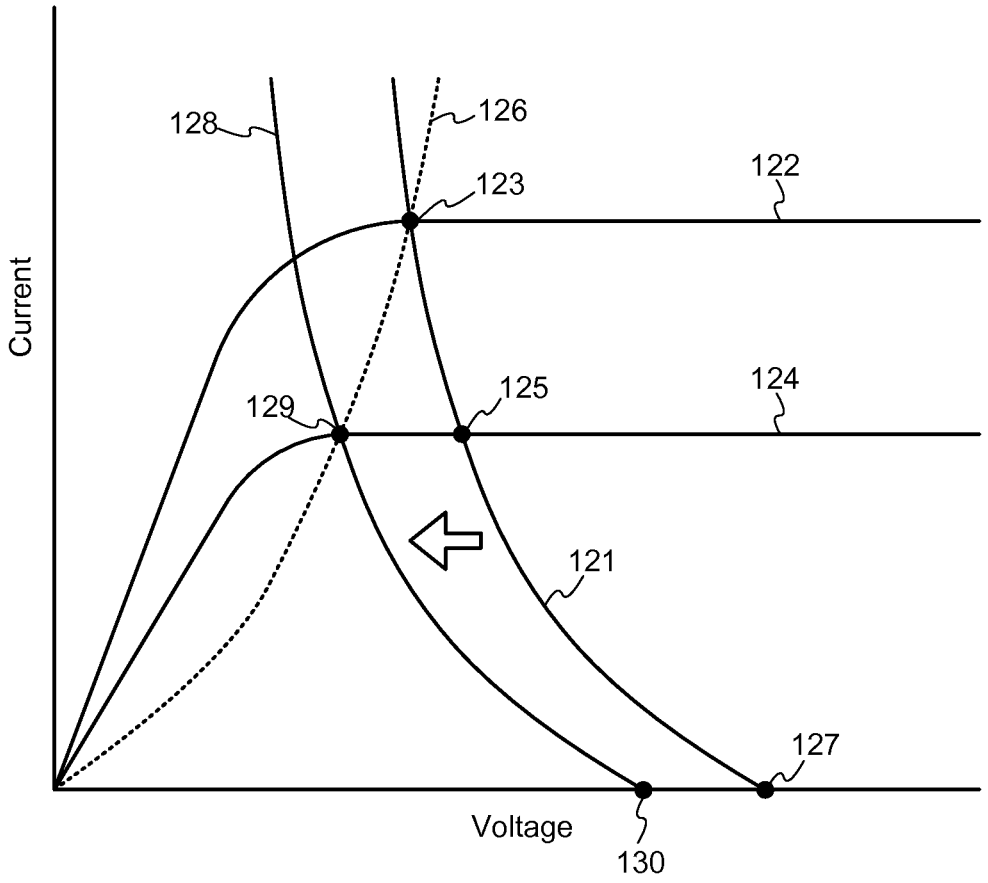
FIG. 4 is a diagram showing load characteristics of a second transistor and an EL element in a display device related to an embodiment of the present invention.

FIG. 4 is a diagram showing the load characteristics of the second transistor 114*b* and EL element 114*d*. In FIG. 4, the horizontal axis is a voltage difference between the first variable power source 111 and second variable power source 112 and the vertical axis is a current (drain current) which flows between the source and drain of the second transistor 114*b*. In this case, the drain current can be considered to be a current which flows to the EL element 114*d*.

In FIG. 4, the curved line 121 is the voltage—current characteristics of the EL element 114*d*, what is called diode characteristics. The EL element 114*d* emits light at a luminosity almost in proportion to the value of a current flowing through the element. The curved line 122 shows the relationship between a voltage between the source and drain of the second transistor 114*b* and a drain current and here illustrates the characteristics of a MOS transistor. That is, the second transistor 114*b* is arranged with a characteristic for not flowing a drain current when the voltage between the source and drain (difference between the source potential and gate potential) is below a certain threshold and flows a drain current when the voltage is above the threshold.

Here, a setting method of a power source voltage of the EL display device 100 in the present embodiment is explained using FIG. 4. First, a maximum luminosity is determined as the EL display device and depending on this, the value of a current which should flow to the EL element 114*d* is determined. As described above, since the value of a current which flows to the EL element 114*d* and the value of a current which flows to the second transistor 114*b* are equal, the intersection point 123 between the curved line 121 and curved line 122 serves as an operating point in the case where a maximum luminosity is obtained. On the other hand, in the case of a minimum luminosity, since the EL element 114*d* does not flow a current, the intersection point 127 between the curved line 121 and the horizontal axis become an operating point in the case where a minimum luminosity is obtained. In addition, the space between the operating point 123 and operating point 127 is an operating point when expressing an arbitrary gradation.

In order to be able to consecutively display luminosity from a minimum luminosity to a maximum luminosity, the operating point 123 for obtaining a maximum luminosity is required to be set in a saturation region of the second transistor 114*b*. In order to minimize power consumption in the EL display device 100 of the present embodiment, the operating point 123 at maximum luminosity is set near the boundary of a saturation region and linear region of the second transistor 114*b*. In this way, a voltage difference between the first variable power source 111 and second variable power source 112 can be set to a minimum and it is possible to minimize power consumption.

Here, in the case where the luminosity of the EL display device 100 is set low by a user, the potential of a data signal output from the analog buffer 115*b* is lowered according to maximum luminosity data based on the set luminosity and the potential supplied to the gate terminal of the second transistor 114*b* is lowered. That is, the gate voltage of the second transistor 114*b* is lowered. In this case, the relationship between the voltage between the source and drain of the second transistor 114*b* and the drain current changes to the relationship shown in the curved line 124. Therefore, the operating point at maximum luminosity also changes to the operating point 125 from the operating point 123.

Furthermore, in the EL display device 100 of the present embodiment, the power source control circuit 131 shown in FIG. 2 changes the output potential of both the first variable power source 111 and the second variable power source 112 according to maximum luminosity data input as a luminosity setting signal, and the position of the curved line 121 becomes misaligned to the position of the curved line 128 as is shown by the arrow. That is, the output potential of the first variable power source 111 is lowered so that the operating point 125 above the curved line 124 shifts to the point 129 above the curved line 126 which shows the boundary between the saturation region and linear region of the second transistor 114*b* and the output potential of the second variable power source 112 is increased.

In this case, the EL element 114*b* emits light at maximum luminosity when operating at the operating point 129 and as well as emitting light at minimum luminosity when operating at the operating point 130, operates at an operating point between the operating point 129 and 130 and thereby expresses an arbitrary gradation.

In this way, in the EL display device 100 of the present embodiment, it is possible to reduce the voltage difference (that is, power source voltage) between the first variable power source 111 and the second variable power source 112 from the operating point 127 to the operating point 130. Therefore, compared to a conventional EL display device, in addition to the effect of reducing power due to a reduction in the value of a current that flows to an EL element, it is possible to obtain a power reduction effects due to a reduction in a power source voltage.

In addition, by lowering the output potential of the first variable power source 111, the power source potential supplied to the logic buffer 115*a* and analog buffer 115*b* is lowered. Therefore, it is also possible to reduce the power consumed by the logic buffer 115*a* and analog buffer 115*b*. In this way, in the EL display device 100 of the present embodiment, it is possible to obtain the effect of a reduction in power in proportion to the square of a power source voltage if the load of the drive IC is a capacitance load and also obtain the effect of a reduction in power in proportion to a power source voltage if the load is a current load.

Next, the structure of a power source circuit and the structure of a power source control circuit of the EL display device 100 in the present embodiment are explained.

Figure 5:
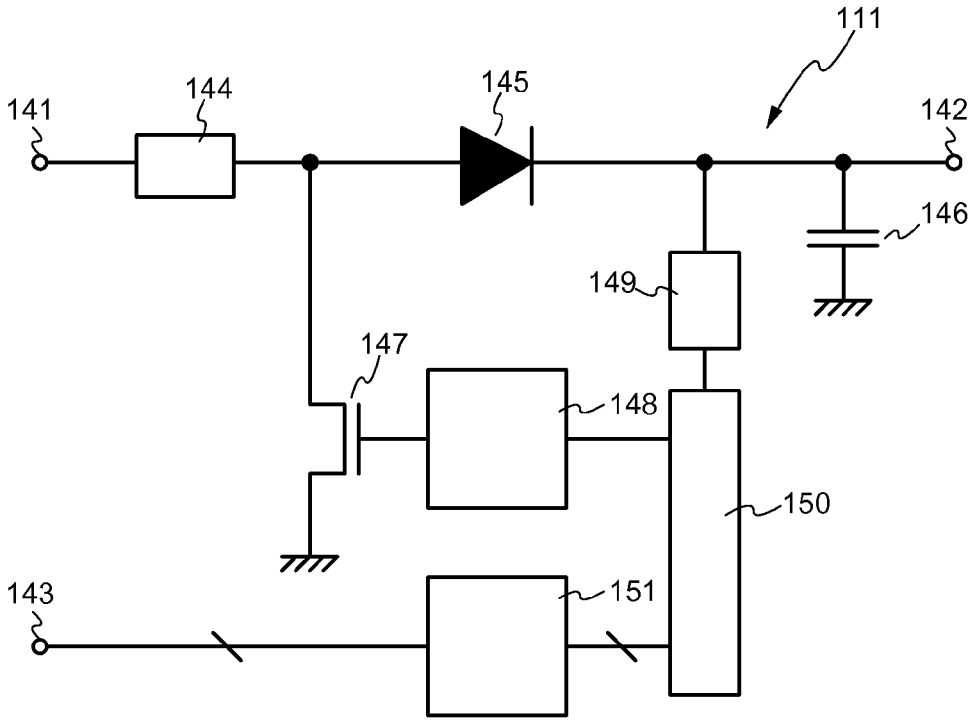
FIG. 5 is a diagram showing a structure of a positive power source circuit in a display device related to an embodiment of the present invention.

FIG. 5 is a diagram showing an example of a circuit structure of the first variable power source (positive power source) 111. The first variable power source 111 in the present embodiment is a rise type switching regulator in which a voltage from 3.0 to 3.3V is input from an input terminal 141 and a voltage from 4.0 to 5.0V is output from an output terminal. In order to make an output voltage variable, an input control signal is input to a control terminal 143. Of course, the structure is not limited to this and an output voltage may be made variable by an input control signal.

As is shown in FIG. 5, the first variable power source 111 is arranged with an inductor 144, a diode 145, an output smoothing condenser 146, a switching transistor 147, a control circuit 148, a resistor 149, a variable resistor 150 and a DA converter 151. An output voltage is split between the resistor 149 and variable resistor 150 and the output of the variable resistor 150 is input to the control circuit 148. In addition, the output of the control circuit 148 is input to a gate terminal of the switching transistor 147 and ON/OFF control of the switching transistor 147 is performed. In this way, feedback control of an output voltage is performed and it is possible to stabilize fluctuation in an output voltage due to a load fluctuation.

The value of a voltage output from the output terminal 142 can be changed by changing the resistance value of the variable resistor 150. An input control signal input to the control terminal 143 is decoded by the DA converter 151 and the variable resistor 150 is controlled based on the decoded data, thereby it is possible to turn the resistance value of the variable resistor 150 into a required resistance value. Specifically, the output voltage of the first variable power source 111 when an input control signal has a reference symbol of 0 is a minimum and is set to become a maximum when the reference symbol is 255.

For example, in the case where the EL element is made to emit light at maximum luminosity (100% luminosity), the resistance value of the variable resistor 150 is set so that the second transistor 114*b* operates at the characteristics shown in the curved line 122 shown in FIG. 4. In addition, in the case where the EL element is made to emit light at medium luminosity (50% luminosity), the resistance value of the variable resistor 150 is set so that the second transistor 114*b* operates at the characteristics shown in the curved line 124 shown in FIG. 4.

Figure 6:
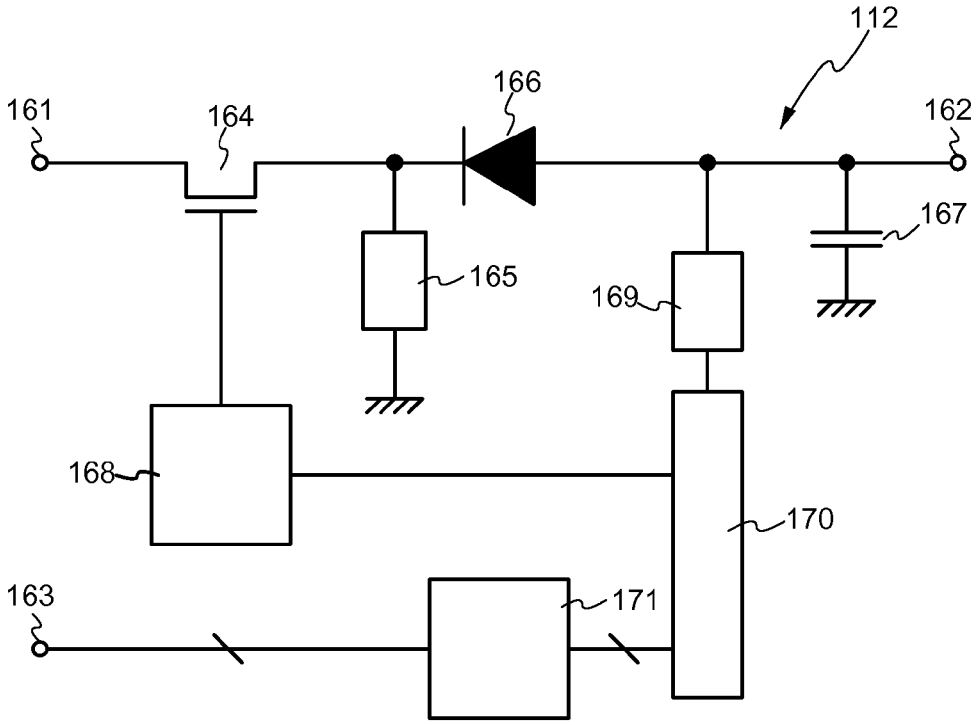
FIG. 6 is a diagram showing a structure of a negative power source circuit in a display device related to an embodiment of the present invention.

FIG. 6 is a diagram showing an example of a circuit structure of the second variable power source (negative power source) 112. The second variable power source 112 in the present embodiment is an inverting type switching regulator in which a voltage from 3.0 to 3.3V is input from an input terminal 161 and a voltage from −5.0 to 15V is output from an output terminal 162. In order to make an output voltage variable, an input control signal is input to a control terminal 163. Of course, the structure is not limited to this and an output voltage may be made variable by an input control signal.

As is shown in FIG. 6, the second variable power source 112 is arranged with a switching transistor 164, an inductor 165, a diode 166, an output smoothing condenser 167, a control circuit 168, a resistor 169, a variable resistor 170 and a DA converter 171. An output voltage is split between the resistor 169 and variable resistor 170 and the output of the variable resistor 170 is input to the control circuit 168. In addition, the output of the control circuit 168 is input to a gate terminal of the switching transistor 164 and ON/OFF control of the switching transistor 164 is performed. In this way, feedback control of an output voltage is performed and it is possible to stabilize fluctuation in an output voltage due to a load fluctuation.

The value of a voltage output from the output terminal 162 can be changed by changing the resistance value of the variable resistor 170. An input control signal input to the control terminal 163 is decoded by the DA converter 171 and the variable resistor 170 is controlled based on the decoded data, thereby it is possible to turn the resistance value of the variable resistor 170 into a required resistance value. Specifically, the output voltage of the second variable power source 112 when an input control signal has a reference symbol of 0 is a minimum and is set to become a maximum when the reference symbol is 255.

For example, in the case where the EL element is made to emit light at maximum luminosity (100% luminosity), the resistance value of the variable resistor 170 is set so that the voltage difference between the first variable power source 111 and second variable power source 112 satisfies the voltage of the operating point 127 in FIG. 4. That is, the resistance value of the variable resistor 170 is set so that the voltage-current characteristics of the EL element 114*d* becomes the curved line 121. In addition, in the case where the EL element is made to emit light at medium luminosity (50% luminosity), the resistance value of the variable resistor 150 is set so that the voltage difference between the first variable power source 111 and second variable power source 112 satisfies the voltage of the operating point 130 in FIG. 4. That is, the resistance value of the variable resistor 170 may be set so that the voltage-current characteristics of the EL element 114*d* becomes the curved line 128.

Figure 7:
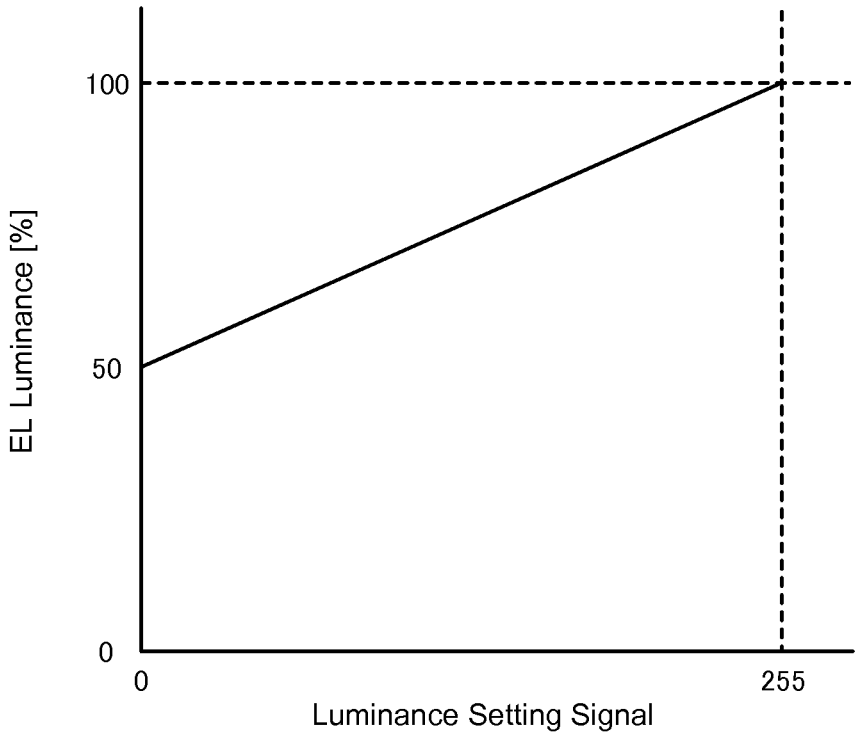
FIG. 7 is a diagram showing a relationship between a luminosity setting signal and EL luminosity in a display device related to an embodiment of the present invention.

FIG. 7 is a diagram showing the relationship between a luminosity setting signal input to the power source control circuit 131 and the luminosity of the EL display device 100. In the present embodiment, a luminosity setting signal is set as an 8 bit digital signal and is minimum luminosity when at 0 and maximum luminosity when at 255. As is shown in FIG. 7, a value from 0~255 is allocated as a luminosity setting signal between a minimum luminosity (50%) and maximum luminosity (100%).

Furthermore, in the present embodiment, although luminosity of a maximum luminosity was set as a minimum luminosity when considering actual usage, usually it may be set between 20% or more and 50% or less. Of course, it is also possible to set the luminosity between 0% or more and 100% or less. In addition, although the luminosity setting signal was set as an 8 bit digital signal, the signal is not limited to this format.

Figure 8:
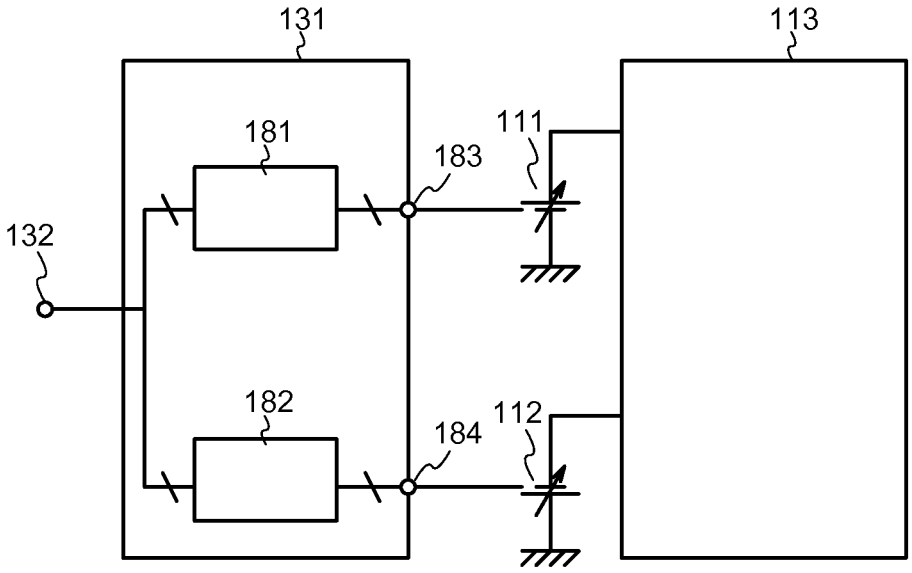
FIG. 8 is a diagram showing a structure of a power source control circuit in a display device related to an embodiment of the present invention.

FIG. 8 is a diagram showing an example of a circuit structure of the power source control circuit 131. The luminosity setting signal input to the external input terminal 132 is input to a first LUT (look up table) 181 and second LUT (look up table) 182. Data for each output conversion is stored in the first LUT 181 and second LUT 182. A conversion result by the first LUT 181 is output from an output terminal 183 and input to the control terminal 143 of the first variable power source 111 shown in FIG. 5. In addition, a conversion result by the second LUT 182 is output from an output terminal 184 and input to the control terminal 163 of the second variable power source 112 shown in FIG. 6.

The data stored in the first LUT 181 and second LUT 182 outputs a control signal to the first variable power source 111 and second variable power source 112 so that the EL display device 100 emits light at an appropriate luminosity according to the input luminosity setting signal. For example, the EL display device 100 emits light at maximum luminosity when the luminosity setting signal formed from an 8 bit digital signal is 255 and a control signal is output so that the EL display device 100 emits light at minimum luminosity when the luminosity setting signal is 0.

Figure 9:
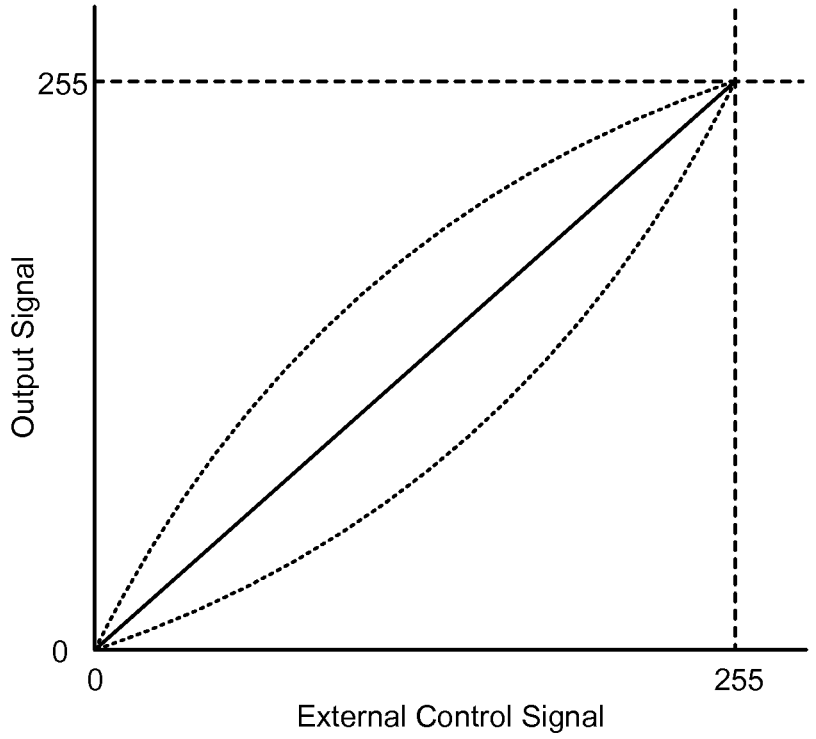
FIG. 9 is a diagram showing a structure of a back-up table in a power source control circuit in a display device related to an embodiment of the present invention.
Figure 10:
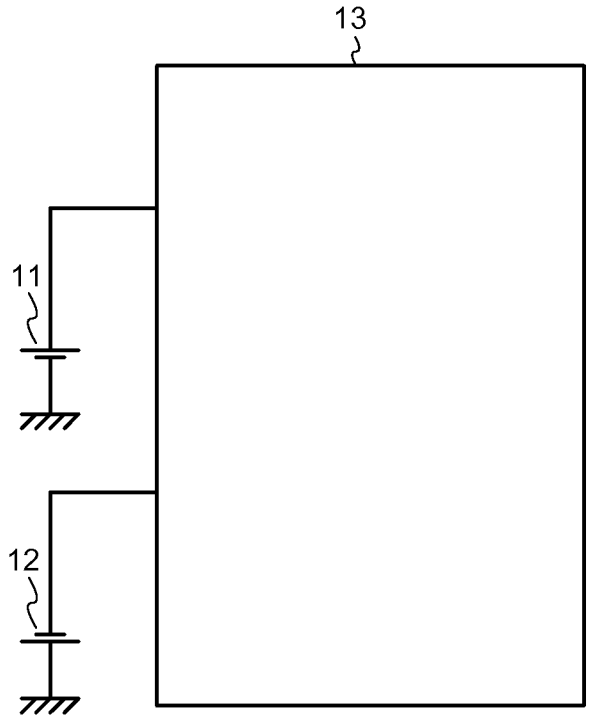
FIG. 10 is a diagram showing an external structure in an EL display device.
Figure 11:
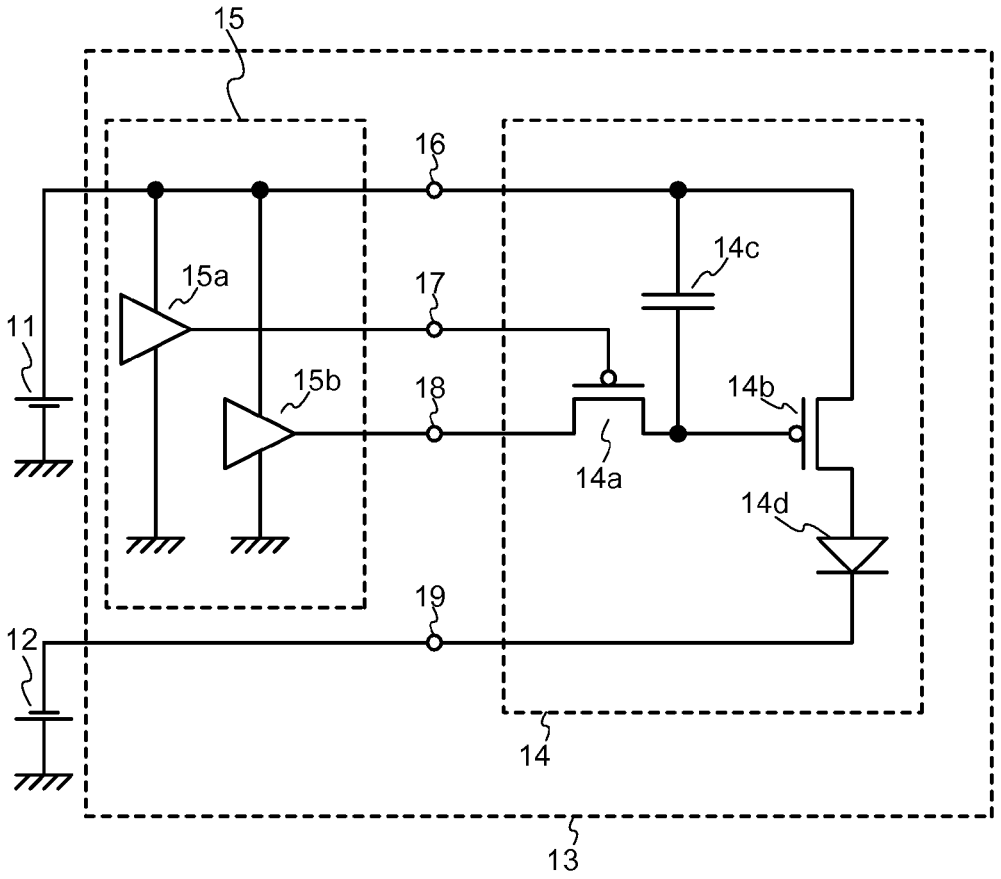
FIG. 11 is a diagram showing a circuit structure of a display control circuit in an EL display device.
Figure 12:
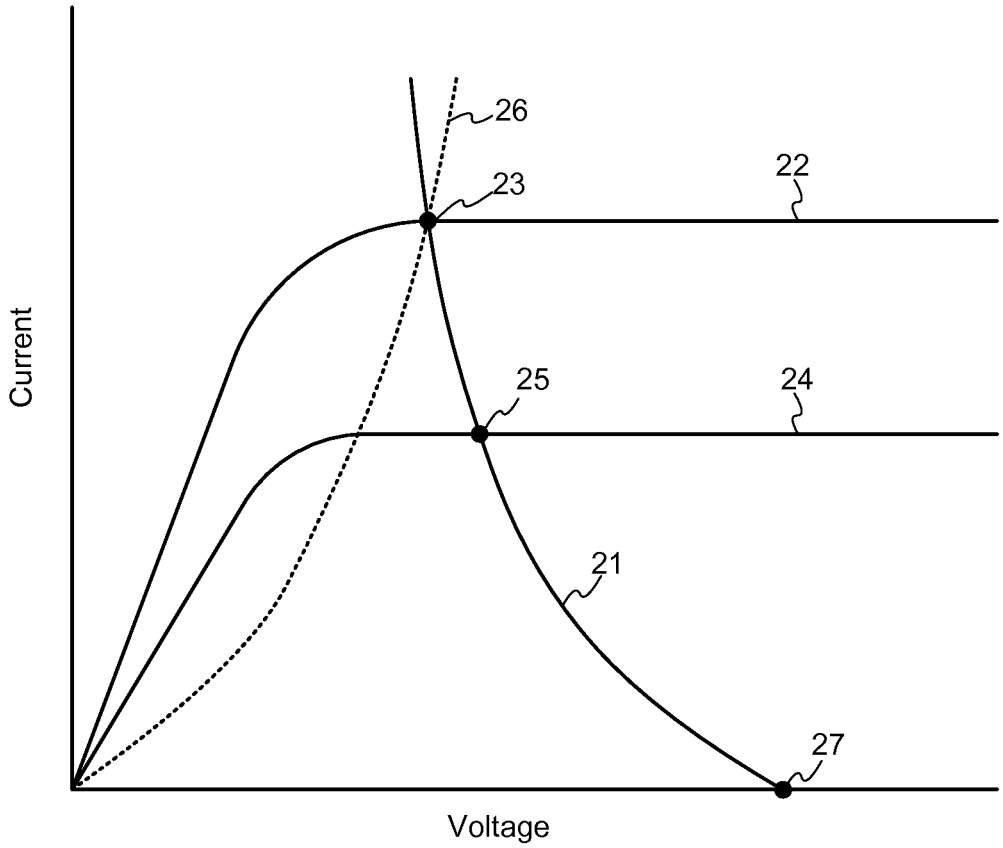
FIG. 12 is a diagram showing load characteristics of a second transistor and an EL element in an EL display device.

FIG. 9 is a diagram showing the input output relationship of the first LUT 181 and the second LUT 182. By using a look up table as the power source control circuit 131, it is possible to realize no only a linear relationship but also various other input output relationships such as a non-linear relationship. That is, if a look up table is used, since it is possible to output various conversion outputs as control signals of a variable power source according to a luminosity setting signal, it is possible to improve luminosity correction and adjustment freedom.

Furthermore, in the present embodiment, an example was shown in which a luminosity setting signal input to the power source control circuit 131 is converted using the look up table and output as a control signal for controlling the first variable power source 111 and second variable power source 112. However, the present invention is not limited to this, it is also possible to form the power source control circuit 131 using an analog logic circuit or digital logic circuit, perform calculations with respect to the input luminosity setting signal and output as a control signal for controlling the first variable power source 111 and second variable power source 112.

Using the EL display device explained as an embodiment of the present invention, a person ordinarily skilled in the art could appropriately perform an addition or removal of structural components or design modification or an addition of processes or an omission or change in conditions which are included in the scope of the present invention as long as they do not depart from the subject matter of the present invention.

In addition, even if the effects are different to the effects brought about by the embodiments described above, those effects which are clear from the descriptions in the present specification or could be easily foreseen by a person ordinarily skilled in the art should also be interpreted as being brought about by the present invention.

What is claimed is:

1. An EL (Electro Luminescence) display device controlling luminosity by a current value supplied to a light emitting element comprising:

a power source supplying a current to the light emitting element and including a first variable power source and a second variable power source outputting a lower potential than the first variable power source;

a control part changing an output potential of the first variable power source and an output potential of the second variable power source according to acquired maximum luminosity data, a gate signal output part; and a data signal output part, wherein the first variable power source is connected to the gate signal output part or the data signal output part, and the control part changes a power source potential of the gate signal output part or a power source potential of the data signal output part according to the maximum luminosity data.

2. The EL display device according to claim 1, wherein the control part acquires the maximum luminosity data based on an acquired image signal.

3. The EL display device according to claim 1, wherein the control part acquires the maximum luminosity data based on acquired user luminosity operation data.

4. The EL display device according to claim 1, wherein the first variable power source is connected to an anode side of the light emitting element and the second variable power source is connected to a cathode side of the light emitting element.

5. The EL display device according to claim 1, wherein the control part is arranged within an external IC (Integrated Circuit).

6. The EL display device according to claim 1, wherein the control part is arranged with a look up table correlating a control signal controlling the first variable power source and the second variable power source and a luminosity setting signal according to the maximum luminosity data.

7. A method of controlling an EL (Electro Luminescence) display device controlling luminosity by a current value supplied to a light emitting element and including a power source supplying a current to the light emitting element including a first variable power source and a second variable power source outputting a lower potential than the first variable power source, a control part making an output potential of the power source variable, a gate signal output part, and a data signal output part, the first variable power source connected to the gate signal output part or the data signal output part, the method comprising:

the control part changing an output potential of the first variable power source and an output potential of the second variable power source, and changing a power source potential of the gate signal output part or a power source potential of the data signal output part according to the maximum luminosity data.

8. The method of controlling an EL display device according to claim 7, wherein the control part acquires the maximum luminosity data based on an acquired image signal.

9. The method of controlling an EL display device according to claim 7, wherein the control part acquires the maximum luminosity data based on acquired user luminosity operation data.

10. The method of controlling an EL display device according to claim 7, wherein the control part changes an output potential of the power source based on a look up table correlating a control signal controlling the first variable power source and the second variable power source and a luminosity setting signal according to the maximum luminosity data.

* * * * *